US006688997B2

(12) United States Patent
Ashino et al.

(10) Patent No.: US 6,688,997 B2
(45) Date of Patent: Feb. 10, 2004

(54) RACKET WITH REDUCED YOKE RIGIDITY

(75) Inventors: Takeshi Ashino, Hyogo (JP); Kunio Niwa, Hyogo (JP); Hiroyuki Takeuchi, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/188,074

(22) Filed: Jul. 3, 2002

(65) Prior Publication Data

US 2003/0064838 A1 Apr. 3, 2003

(30) Foreign Application Priority Data

Aug. 28, 2001 (JP) ..... 2001-258612

(51) Int. Cl.[7] ..... A63B 49/00

(52) U.S. Cl. ..... 473/535; 473/521; 473/537; 473/546

(58) Field of Search ..... 473/520, 521, 473/524, 535, 536, 537, 546

(56) References Cited

U.S. PATENT DOCUMENTS

| | | | | |
|---|---|---|---|---|
| 4,997,186 A | | 3/1991 | Carr | |
| 5,310,516 A | | 5/1994 | Shen | |
| 5,462,274 A | * | 10/1995 | Takatsuka | 473/537 |
| 5,507,486 A | * | 4/1996 | Miyamoto | 473/535 |
| 5,538,243 A | * | 7/1996 | Yamamoto et al. | 473/537 |
| 5,913,740 A | * | 6/1999 | Miklos | 473/537 |
| 6,293,878 B1 | * | 9/2001 | Iwatsubo et al. | 473/521 |

FOREIGN PATENT DOCUMENTS

| | | | | |
|---|---|---|---|---|
| GB | 2 344 292 A | | 6/2000 | |
| JP | 9-285569 | | 11/1997 | |
| JP | 10-295855 | | 11/1998 | |
| JP | 2000-14833 | * | 1/2000 | A63B/49/02 |
| JP | 2001-061996 | | 3/2001 | |
| JP | 2001-204853 | * | 7/2001 | |

* cited by examiner

*Primary Examiner*—Raleigh W. Chiu
(74) *Attorney, Agent, or Firm*—Birch, Stewart, Kolasch & Birch, LLP

(57) ABSTRACT

A racket frame (1) has a pipe-shaped racket-frame body (2) made of a fiber reinforced resin and composed of a head (3), a throat part (4), a shaft part (5), and a grip part (6) sequentially arranged and a yoke (10) connected to the racket-frame body (2). In this construction, supposing that the head (3) is a clock face and that the top position of the head (3) is 12 o'clock, a yoke rigidity value at a central position P1, vertical to a ball-hitting face (F), of the yoke (10) in a longitudinal direction thereof is in a range of 10% to 70% of a face rigidity value which is an average of a rigidity value at a 12 o'clock position (P2) vertical to the ball-hitting face (F) and a rigidity value at a three o'clock position (P3) vertical to the ball-hitting face (F).

11 Claims, 11 Drawing Sheets

RACKET WITH REDUCED YOKE RIGIDITY

BACKGROUND OF THE INVENTION

1. Field of the Invention

The present invention relates to a racket frame and in particular, a tennis racket frame lightweight and excellent in its restitution performance.

2. Description of the Related Art

In recent years, there is proposed a so-called "thick racket" which is thick in an out-of-plane direction (ball-hitting direction) of the ball-hitting face of the racket frame. Females and seniors need the thick racket because they want to hit a tennis ball thereby at a high speed with a small force. The tennis racket they want is lightweight and excellent in ball-flying performance.

However, in consideration of a collision between the racket frame and a ball, the lightweight racket frame has a low restitution coefficient, according to the principle of the conservation of energy. That is, the light weight of the racket frame causes deterioration of its restitution performance. As a method of improving the restitution performance of the racket frame without increasing its weight, partly changing the rigidity of the racket frame [partly] is proposed.

For example, to improve the restitution performance of the racket frame, the tennis racket disclosed in Japanese Patent Application Laid-Open No.9-285569 has a highly rigid material extended from its face-side part to an extension direction of its face part to improve the rigidity value of the face-side part and reduce the deformation of the face part when a tennis ball is hit.

The present applicant proposed a racket frame as disclosed in Japanese Patent Application Laid-Open No.10-295855. The sectional peripheral length of the racket frame is constant, and only the sectional configuration of a particular portion is altered to reduce the moment of inertia of the section and increase the rigidity in the out-of-plane direction of the ball-hitting face. This racket frame has improved restitution performance.

However, the tennis racket disclosed in Japanese Patent Application Laid-Open No.9-285569 has the problem that although the tennis racket is lightweight, it does not have sufficient restitution performance, and the balance is great owing to the extension of the highly rigid material in the face-side part. Thus the tennis racket has a low operability. Also, the insertion of the highly rigid material into a part of the face part causes concentration of a stress and hence the strength of the racket frame deteriorates.

The racket frame disclosed in Japanese Patent Application Laid-Open No.10-295855 is lightweight and has preferable restitution performance. However since the sectional peripheral length of the racket frame is constant, it is impossible to change its rigidity value greatly. Thus there is room for improvement in its restitution performance.

SUMMARY OF THE INVENTION

The present invention has been made in view of the above-described demands. Thus, it is an object of the present invention to provide a racket frame that is lightweight without deteriorating its strength and superior in its restitution performance.

In order to achieve this object, according to the present invention, there is provided a pipe-shaped racket frame having a racket-frame body made of a fiber reinforced resin and composed of a string-stretched part (head), a throat part, a shaft part, and a grip part sequentially arranged and a yoke connected to the racket-frame body. In this construction, supposing that the head is a clock face and that a top position of the head is 12 o'clock, a yoke rigidity value at a central position, which is a vertical direction to a ball-hitting face, of the yoke in a longitudinal direction, is in a range of 10% to 70% of a face rigidity value which is an average of a rigidity value of a vertical direction to the ball-hitting face at a 12 o'clock position of the head and at a three o'clock position of the head.

As a result of their energetic researches, the present inventors found out that a racket frame that is lightweight and has improved restitution performance without deteriorating its strength is obtained by setting the yoke rigidity value at the central position of the yoke vertical to the ball-hitting face smaller than the face rigidity value which is the average of the rigidity value at the 12 o'clock position of the head vertical to the ball-hitting face and the rigidity value at the three o'clock position of the head vertical to the ball-hitting face and by integrally molding a fiber reinforced resin having a hollow portion to form the racket-frame body.

By setting the yoke rigidity value vertical to the ball-hitting face smaller than the face rigidity value vertical thereto, the head does not deform easily owing to its high rigidity, whereas the yoke flexes easily with the ball-hitting face, owing to its low rigidity, when a ball collides with the string-stretched ball-hitting face. Thereby vertical strings (guts) can be deformed greatly. Thus it is possible for the racket frame whose body is made of a fiber reinforced resin to have improved restitution performance without deteriorating its strength.

The yoke rigidity value is set not less than 10% of the face rigidity value nor more than 70% thereof, favorably not less than 30% thereof nor more than 70% thereof, and more favorably not less than 35% thereof nor more than 50% thereof.

If the yoke rigidity value is set less than 10% of the face rigidity value, the yoke has a low strength. On the other hand, if the yoke rigidity value is set more than 70% of the face rigidity value, the yoke is not flexible sufficiently and thus the restitution performance of the racket frame cannot be improved.

The yoke rigidity value is measured at the central position of the yoke in its longitudinal direction, vertical (frame thickness direction) to the ball-hitting face. As will be described later, the rigidity value is measured by a three-point bending method at the central position between two racket frame-supporting points (the central position in the longitudinal direction of the yoke) 70 mm (2.75 in.) apart from each other. Supposing that the head is a clock face, the top position of the head is 12 o'clock. The face rigidity value is the average of the rigidity value at the 12 o'clock position vertical to the ball-hitting face and the rigidity value at the three o'clock position vertical to the ball-hitting face measured in a method similar to the above method.

The yoke rigidity value is not less than 60 kgf/cm (338 lbf/in) nor more than 500 kgf/cm (2820 lbf/in), favorably not less than 100 kgf/cm (564 lbf/in) nor more than 450 kgf/cm (2538 lbf/in), and more favorably not less than 200 kgf/cm (1128 lbf/in) nor more than 350 kgf/cm 1974 lbf/in).

If the yoke rigidity value is set less than 60 kgf/cm (338 lbf/in), the yoke has a low strength. On the other hand, if the yoke rigidity value is set more than 500 kgf/cm (2820 lbf/in), the yoke is not flexible sufficiently and thus the restitution coefficient of the racket frame cannot be improved.

It is preferable that the yoke consists of a fiber reinforced resin, a resin, a metal, a wood or a composite material thereof.

As a metal, it is favorable to use lightweight metal such as aluminum, titanium, magnesium, and the like or alloys containing one of these lightweight metals as the main component. To allow the racket frame to have a high vibration-damping effect, it is more favorable to use a fiber-reinforced thermoplastic resin. As a matrix resin, polyamide resin and a mixture of polyamide and ABS resin are preferably used. As a reinforcing fiber, a short carbon fiber is preferably used.

The yoke is manufactured by a method of injection-molding a thermoplastic resin or the like reinforced with short carbon fibers or the like; a molding method of weaving co-mingled yarns of a polyamide fiber and a carbon fiber into a braid and fusing a polyamide to impregnate the reinforcing fiber therewith; or a method of forming RIM nylon by injecting a RIM nylon monomer into a laminate consisting of foamed epoxy, a nylon tube coating the foamed epoxy, and a carbon braid layered on the nylon tube.

To allow the racket-frame body to be lightweight and have a preferable rigidity and strength, it is preferable that the reinforcing fiber consists of a continuous fiber. The strength and rigidity of the racket-frame body maybe increased by composing the matrix resin of a thermosetting resin. The vibration-damping performance of the racket-frame body may be enhanced by composing the matrix resin of a thermoplastic resin. In view of the strength and rigidity of the racket-frame body, it is preferable that a carbon fiber is used as the reinforcing fiber and that an epoxy resin is used as the matrix resin. The fiber reinforced resin of the racket-frame body is arbitrarily selected according to the main function of the racket frame.

It is preferable that a groove is formed on the yoke at a ball-hitting face side thereof along a circumferential direction of the ball-hitting face. As the configuration of the groove, it is preferable that its width is in the range of 4 mm (0.16 in) to 6 mm (0.23), its depth is in the range of 4 mm (0.16 in) to 6 mm (0.23 in), and its length in the circumferential direction of the ball-hitting face is in the range of 20 mm (0.78 in) to 120 mm (4.7 in). Thereby it is possible to reduce the yoke rigidity value in the direction of the ball-hitting face and increase the movable range of the string by the depth of the groove, supposing that a tennis ball is hit in the same area of a racket frame having a groove and a racket frame lacking a groove. Thus the racket frame of the present invention having a groove has improved restitution performance.

It is preferable that the thickness of the yoke is not less than 10 mm (0.39 in) nor more than 25 mm (0.98 in) and its width is not less than 10 mm (0.39 in) nor more than 20 mm (0.78 in). if the thickness and width of the yoke are less than 10 mm (0.39 in), its strength is low. On the other hand, if the thickness and width of the yoke are more than 25 mm (0.98 in) and 20 mm respectively (0.75 in), its rigidity is high and thus it is difficult to improve the restitution performance of the racket frame. The length of the yoke (the horizontal distance between right and left points of connection between the yoke and the racket-frame body) is not less than 75 mm (2.9 in) nor more than 150 mm (5.8 in) and favorably not less than 85 mm (3.3 in) nor more than 120 mm (4.7 in). If the length of the yoke is less than the lower limit, the effect of its rigidity is low. On the other hand, if the length of the yoke is more than the upper limit, a tennis racket is too large. Thus a tennis racket has a problem in at least one of strength, weight, and operability.

The thickness of the head of the racket-frame body is not less than 18 mm (0.70) nor more than 30 mm (1.2 in) and favorably not less than 10 mm (0.39 in) nor more than 20 mm (0.78 in). If the thickness of the head is less than the lower limit, the rigidity of the head is insufficient. On the other hand, if the thickness of the head is more than the upper limit, the strength of the head is low. To allow the head to have a high strength in this case, it is necessary to increase the weight thereof, which leads to unfavorable operability of a tennis racket.

It is preferable that the racket-frame body and the yoke are formed separately and that the yoke and the racket-frame body are connected to each other by a mechanical connection means and/or an adhesive agent.

The material for the yoke and the material for the racket-frame body are not integrally molded but separately molded, and the molded material for the yoke and the molded material for the racket-frame body are connected to each other by a mechanical connection means. Therefore it is possible to secure the force of connecting the yoke and the racket-frame body to each other. Since the connection surface of the yoke and that of the racket-frame body are not integrated with each other, a shear load generated when the racket frame deforms is collectively applied to the connection surface of the yoke and that of the racket-frame body. Thereby vibrations generated on the entire racket frame are suppressed, which prevents occurrence of tennis elbow.

The connection portion of the yoke and that of the racket-frame body deform greatly in the primary and secondary vibrations in the out-of-plane direction. Thus the shear load can be easily collectively applied to the boundary between the yoke and the racket-frame body. Consequently it is possible to effectively suppress vibrations generated on the entire racket frame. Thus the racket frame of the present invention has a high vibration-damping performance.

A mechanical connection means connects objects to each other without the intermediary of a viscous material or a chemical connection force. A mechanical connection means is used to connect the objects to each other depending upon a difference in the configuration of the objects and a combination of variations thereof. Mechanical connection means include fit-on of a concavity and a convexity, screw-tightening, fitting, engagement, locking, bolt/nut, spring, and the like. Of these means, fit-on of a concavity and a convexity and screw-tightening are favorably used.

The mechanical connection means is required to hold a string force and withstand an impact force applied to the racket frame by a tennis ball. More specifically, a convexity is formed on the inner side of the racket-frame body or the connection surface of the yoke, while a concavity which fits on the convexity is formed on the inner side of the racket-frame body or the connection surface of the yoke. The yoke and the racket-frame body fit on each other by fit-on of the convexity and the concavity. In the case where the convexity is formed on the racket-frame body and the concavity is formed on the yoke, the restraint on the yoke relative to the racket-frame body is small. Thus it is easy to fit the yoke and the racket-frame body on each other. It is preferable that the racket-frame body has a depression corresponding to the configuration of the connection auxiliary part of the yoke to fittingly lock the connection auxiliary part and the racket-frame body to each other. Thereby it is possible to prevent both from shifting from each other and enhance the connection therebetween.

The right and left ends of the yoke are connected to the right and left parts of the racket-frame body respectively in not less than 10 $cm^2$ (1.6 $in^2$), favorably not less than 20 $cm^2$ (3.2 $in^2$), and more favorably not less than 30 $cm^2$ (4.8 $in^2$). If the area of the connection portion of the yoke and that of the racket-frame body is less than 10 $cm^2$ (1.6 $in^2$), a sufficient vibration-damping effect cannot be obtained. To increase the vibration-damping performance, it is desirable that the area of the connection portion is large. But in view of the strength and weight of the racket frame, the area of the connection portion is favorably less than 60 $cm^2$ (9.6 $in^2$). By changing the area of the connection portion, the vibration-damping performance can be controlled. Thus it is possible to appropriately set the vibration-damping factor according to player's preference for a feeling (degree of vibration) the player has in hitting a tennis ball with a tennis racket.

An adhesive agent superior in vibration-absorbing property and/or a vibration-damping film or a vibration-damping sheet may be interposed on the boundary between the racket-frame body and the yoke. Furthermore a high vibration-damping material (vibration-damping film, vibration-damping sheet or vibration-damping paint) may be disposed on at least one portion of the boundary between the racket-frame body and the yoke. By selecting an appropriate vibration-damping material, it is easy to adjust the vibration-damping performance of the racket frame. The vibration-damping material maybe used singly or in combination with an adhesive agent.

The high vibration-damping material is particularly effective when the yoke and the racket-frame body are separately formed. In the case where an adhesive agent having a lower elastic modulus than the yoke and the racket-frame body is used in combination with a vibration-damping material, the effect of the adhesive force of the adhesive agent obtained in connecting both to each other is superior, and a shear stress is collectively applied to the boundary between the racket-frame body and the yoke. Therefore the racket frame has superior vibration-damping performance.

By interposing an adhesive agent and a vibration-damping material on the boundary between the racket-frame body and the yoke, it is possible to prevent generation of an unpleasant sound.

As the vibration-damping film, dipole gee film manufactured by C.C.I., Inc. is preferably used.

As the adhesive agent, those that are flexible are preferable. In addition to those composed of epoxy resin, those composed of urethane are preferable. Concrete examples are shown below.

- A high separation-resistant and shock-resistant adhesive agent containing cyanoacrylate and elastomer as its base. For example, 1731•1733 produced by Three-Bond, Inc. is commercially available.
- A cold-cure type two-pack epoxy resin having stable toughness formed by uniformly dispersing fine rubber particles in the epoxy resin. As an adhesive agent under a high shear, 2082C produced by Three-Bond, Inc. is commercially available.
- An elastic adhesive agent of one-can moisture-cure type which contains a silyl group-containing specific polymer as its main component and hardens in reaction with a slight amount of water contained in air. For example, 1530 produced by Three-Bond, Inc. is commercially available.
- A urethane resin adhesive agent: "Esprene" is commercially available.
- "Redux 609", "AW106/HV953U", and "AW136A/B" produced by Ciba-Geigy, Inc. are commercially available.
- "E-214" produced by LOCTITE, Inc. is commercially available.
- "DP-460" and "9323B/A" produced by 3M, Inc. are commercially available.

It is preferable that the yoke has right and left connection auxiliary parts each extending from one end of the body of the yoke that closes an opening of the head, with each of the right and left connection auxiliary parts extending across the boundary between the head and the throat part, that each of the right and left connection auxiliary parts is extended up to a position of four o'clock (eight o'clock) of the head, supposing that the head is a clock face, and that the top position of the head is 12 o'clock, and each of the right and left connection auxiliary parts is extended up to the shaft part at the throat-part side.

The connection auxiliary part allows the yoke and the racket-frame body to be connected to each other in a large area and thus the connection surface of each of the yoke and the racket-frame body to easily receive a shear load. By collectively applying a stress to each of the connection surfaces, a high vibration-damping function can be easily displayed, and the yoke can be connected to the racket-frame body with a strong force.

The connection auxiliary part is extended up to the position of four o'clock (eight o'clock). The position of four o'clock (eight o'clock) is included in the loop of the secondary vibration mode. Thus the vibration-damping effect can be increased by extending the connection auxiliary part to the position of four o'clock (eight o'clock). When the connection auxiliary part is extended toward the position of 12 o'clock beyond the position of four o'clock, the racket frame has a large balance and the tennis racket has a low operability.

At the throat-part side, the connection auxiliary part may be extended to the shaft-part.

By adjusting the extension length of the connection auxiliary part to the head and to the throat part, the vibration-damping performance can be controlled and the balance point can be adjusted. Further by adjusting the extension length of the connection auxiliary part to the head, the area of the ball-hitting face can be also altered. Furthermore by altering the position of the body of the yoke to the top side of the entire racket frame or the grip side thereof, the area of the ball-hitting face of the racket frame can be easily altered.

Each of the right and left connection auxiliary parts has an equal and uniform dimension in one region and a nonuniform dimension in other region in a thickness direction thereof. The dimension of the connection auxiliary part in its thickness direction is set smaller than that of the racket-frame body in its thickness direction to prevent the connection auxiliary part from projecting from the racket-frame body.

By making the dimension of the connection auxiliary part in its thickness direction nonuniform, it is possible to fit the convexity of the racket-frame body and the concavity of the connection auxiliary part (or the concavity of the racket-frame body and the convexity of the connection auxiliary part) on each other with a higher force and make the connection auxiliary part look attractive.

Preferably, each of the right and left connection auxiliary parts of the yoke is extended to the shaft part along an inner surface of the throat part in such a way that a leading end of the right connection auxiliary part is continuous with that of the left connection auxiliary part to form an approximately hollow triangular space with the connection auxiliary part and the body of the yoke. This configuration increases the strength of the yoke.

It is preferable that the yoke has a projection projected from a portion at which the leading end of the right connection auxiliary part is continuous with the leading end of the left connection auxiliary part toward the shaft part. It is preferable that the projection is inserted into a slit formed at a center of a leading end of the shaft part. By inserting the projection into the slit formed on the shaft part, it is easy to dispose the yoke at a predetermined position of the racket-frame body and connect the yoke and the racket-frame body to each other in a large area to thereby enhance the vibration-damping performance of the racket frame.

Both ends of the body of the yoke and a connection auxiliary part extending from the both ends of the body of the yoke are connected to an inner-surface side of the racket-frame body by superimposing an outer surface of the connection auxiliary part and an inner surface of the racket-frame body on each other (former construction). Otherwise, the yoke and the racket-frame body are connected to each other by fitting the connection auxiliary part on a fit-on portion formed on the inner surface of the racket-frame body in correspondence to a configuration of the connection auxiliary part (latter construction).

The former construction is larger in the area of the contact between the yoke and the racket-frame body than the latter construction. The latter construction allows the racket frame to be lightweight.

The weight of the yoke is set to the range of favorably 5%–30% and more favorably 10%–25% of the weight of a raw frame whose weight is the addition of the weight of the yoke and that of the racket-frame body.

If the weight of the yoke is less than 5% of the weight of the raw frame, the yoke has a low strength. On the other hand, if the weight of the yoke is more than 30% of the weight of the raw frame, the weight of the yoke is too large.

The weight of the racket frame is not less than 100 g (0.22 lbs) nor more than 280 g (0.62 lbs) and favorably not less than 200 g (0.44 lbs) nor more than 260 g (0.57 lbs). If the weight of the racket frame is less than 100 g (0.22 lbs), a tennis racket has an insufficient strength. On the other hand, if the weight of the racket frame is more than 280 g (0.62 lbs), the weight of the tennis racket cannot be reduced. The weight of the racket frame means the weight of a finished product (the weight of paint and that of the grip part) of the racket frame not having strings mounted thereon.

The resin for use in the racket frame of the present invention includes a thermosetting resin and a thermoplastic resin, as described above. A thermosetting resin includes epoxy resin, unsaturated polyester resin, phenol resin, melamine resin, urea resin, diallyl phthalate resin, polyurethane resin, polyimide resin, and silicon resin.

A thermoplastic resin includes polyamide resin, saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

As reinforcing fibers for use in the fiber reinforced resin, fibers which are used as high-performance reinforcing fibers can be used. For example, it is possible to use carbon fiber, graphite fiber, aramid fiber, silicon carbide fiber, alumina fiber, boron fiber, glass fiber, aromatic polyamide fiber, aromatic polyester fiber, ultra-high-molecular-weight polyethylene fiber, and the like. Metal fibers may be used as the reinforcing fiber. A carbon fiber is preferable because it is lightweight and has a high strength. These reinforcing fibers can be used in the form of long or short fibers. A mixture of two or more of these reinforcing fibers may be used. The configuration and arrangement of the reinforcing fibers are not limited to specific ones. For example, they may be arranged in a single direction or a random direction. The reinforcing fibers may have the shape of a sheet, a mat, fabrics (cloth), braids, and the like.

The racket-frame body is not limited to a laminate of fiber reinforced prepregs. The racket-frame body may be formed by winding reinforcing fibers on a mandrel by filament winding to form a layup, disposing the layup in a die, and filling the thermoplastic resin such as rim nylon into the die.

BRIEF DESCRIPTION OF THE DRAWINGS

FIG. 8 shows a racket frame according to a third embodiment, in which

DETAILED DESCRIPTION OF THE PREFERRED EMBODIMENTS

Figure 1:
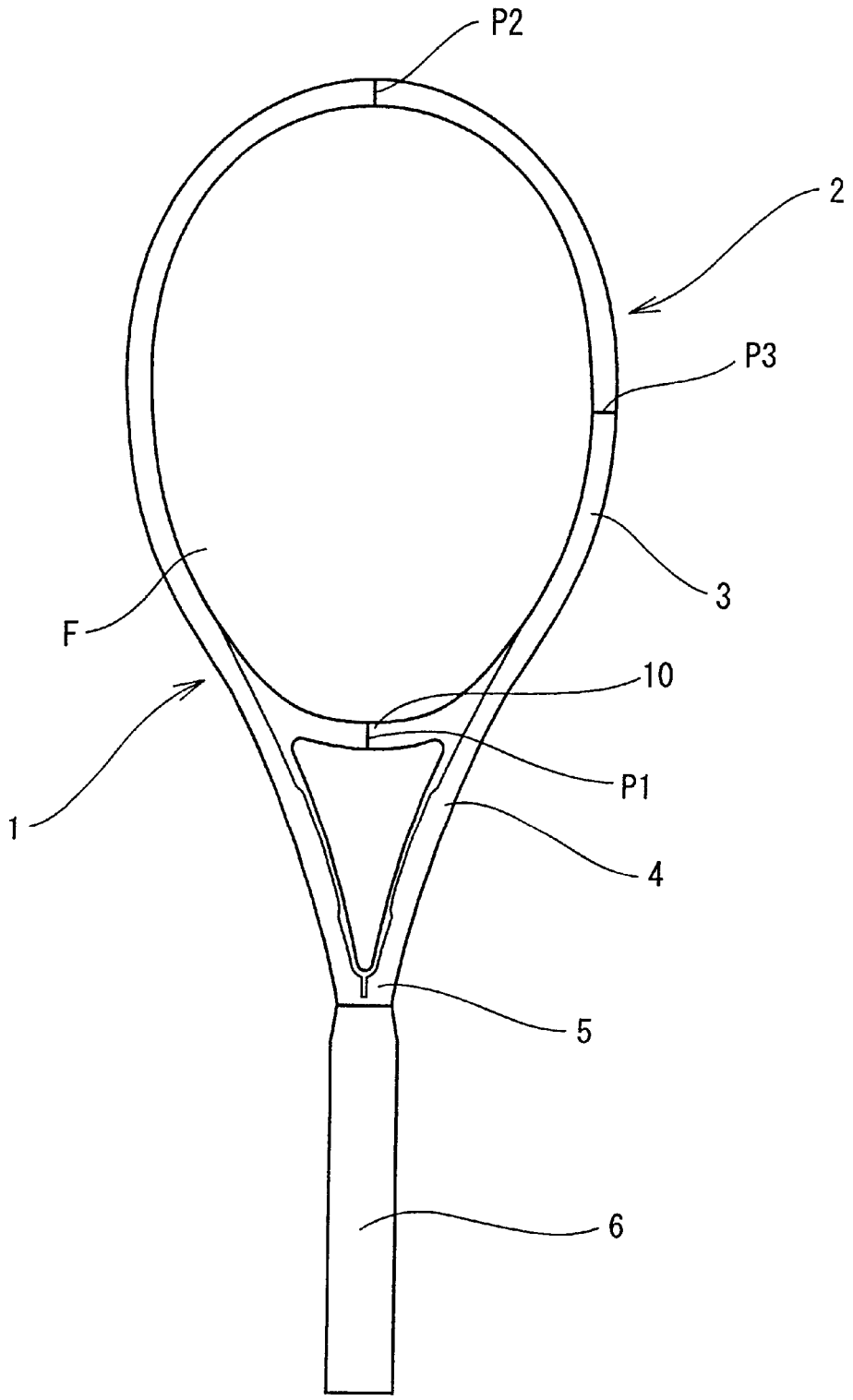
FIG. 1 is a schematic front view showing a racket frame according to a first embodiment of the present invention.

The embodiments of the present invention will be described below with reference to the drawings.

FIGS. 1 through 5 show a racket frame 1 according to a first embodiment of the present invention. The racket frame 1 is composed of a racket-frame body 2 and a yoke 10 formed separately from the racket-frame body 2. The racket-frame body 2 is composed of head part 3, a throat part 4, a shaft part 5, and a grip part 6. These parts 3 through 6 are continuously formed. An annular ball-hitting plane F is constructed with the head 3 and the yoke 10, made of a material different from that of the head 3, continuous with the head 3. The yoke 10 is connected to the racket-frame body 2 in the range of the right and left throat parts 4 and the head 3.

The yoke 10 has a body 10A closing an opening of the head 3 and a connection auxiliary part 10B extending from both ends of the yoke body 10A, with the connection auxiliary part 10B extending across the boundary between the head 3 and the throat part 4.

A yoke rigidity value at a central position P1, vertical to a ball-hitting face F, of the yoke 10 in the longitudinal direction thereof is 258 kgf/cm. Supposing that the head 3 is a clock face and that the top position of the head 3 is 12 o'clock, a face rigidity value which is the average of a rigidity value at a 12 o'clock position P2 vertical to the ball-hitting face F and a rigidity value at a three o'clock position P3 vertical to the ball-hitting face F is 670 kgf/cm (3779 lbf/in). Thus, the yoke rigidity value is about 39% of the face rigidity value.

With reference to FIG. 4, on the yoke body 10A at the ball-hitting face side thereof, there is formed a groove 10*c* having a width S1 of 5 mm (0.2 in), a depth S2 of 5 mm (0.2 in), and a length of 90 mm (3.5 in). The groove 10*c* extends along the circumferential direction of the ball-hitting face to form a string opening g on the ball-hitting face side of the yoke body 10A. The weight of the yoke 10 is 33 g ((0.07 lbs). The weight of the racket frame is 245 g (0.54 lbs). The ball-hitting area is 110 square inches (707 $cm^2$).

The racket-frame body 2 is composed of a hollow pipe, having a hollow portion 8, made of fiber reinforced resin, namely, a laminate of fiber reinforced prepregs each consisting of a carbon fiber serving as the reinforcing fiber impregnated with epoxy resin serving the matrix resin. The yoke 10 is made of a solid injection-molded material. More specifically, the yoke 10 is made of a mixture of 66 nylon which is a thermoplastic resin and 15% of carbon fibers (short fiber), having a length of 1 m (3.3 ft), which is filled into the 66 nylon.

Figure 2A:
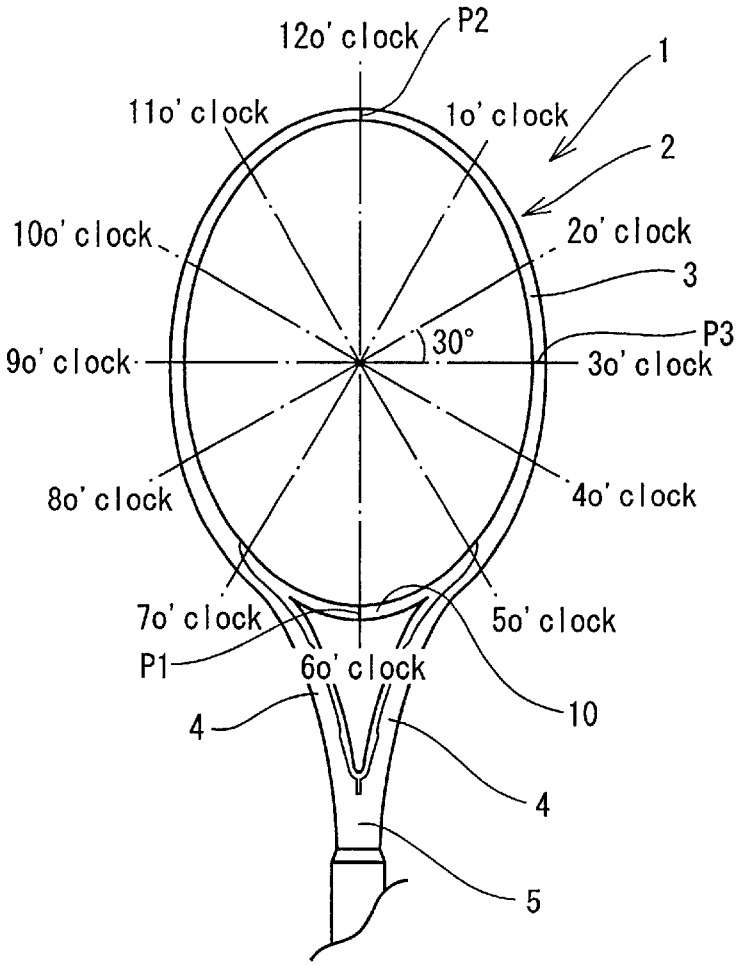
FIG. 2A shows a position where rigidity values are measured.
Figure 2B:
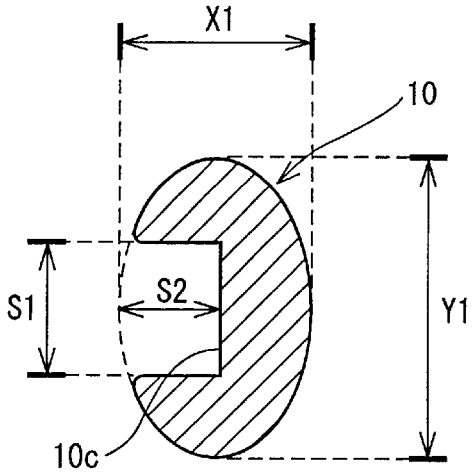
FIG. 2B is a sectional view showing a central position of a yoke in its longitudinal direction.
Figure 2C:
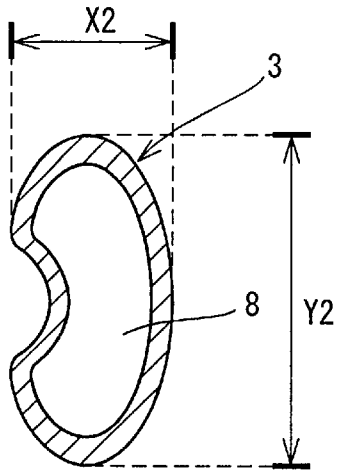
FIG. 2C is a sectional view showing a three o'clock position of ahead.
Figure 3:
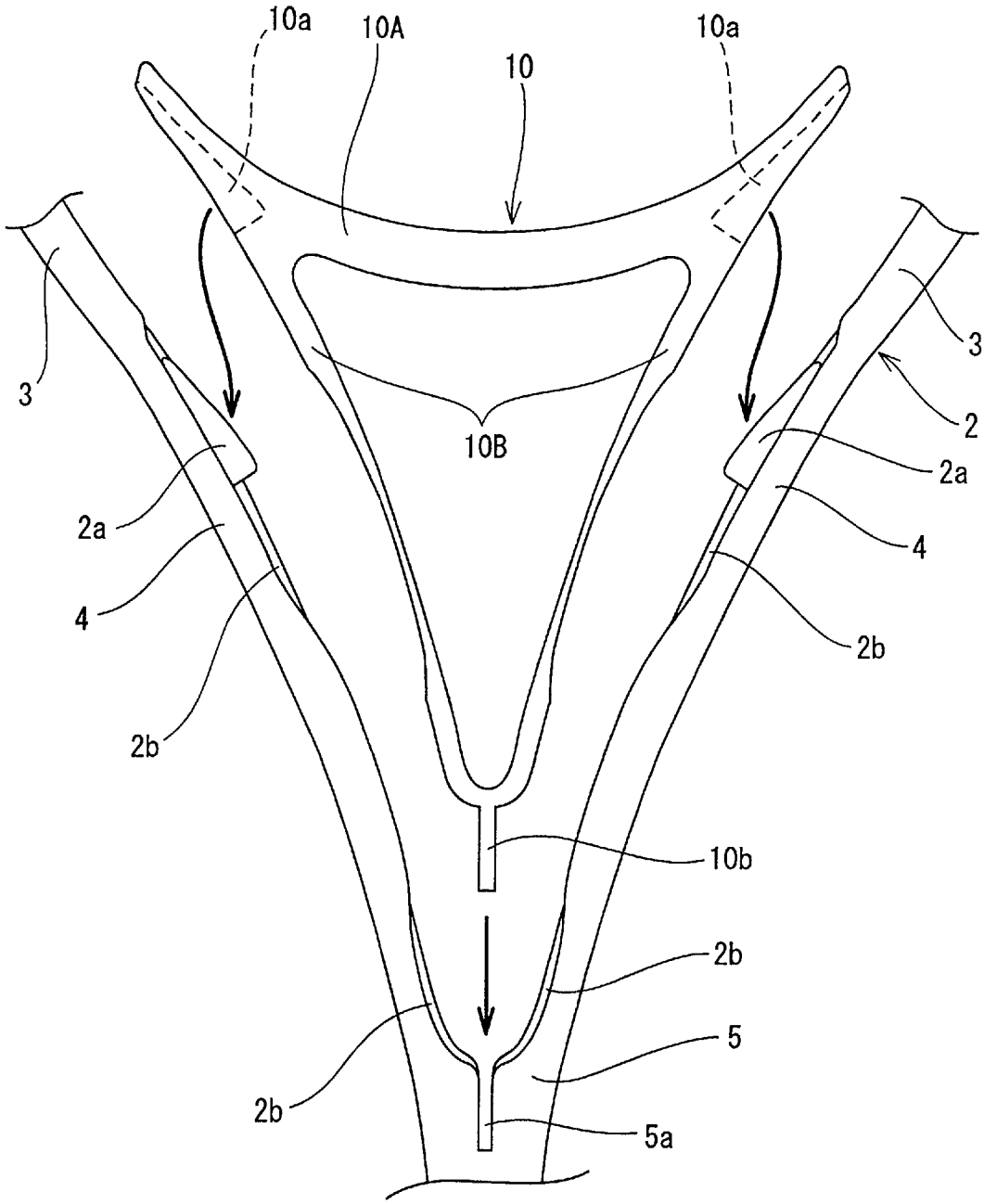
FIG. 3 is an enlarged view showing main portions of the racket-frame body and the yoke.
Figure 4A:
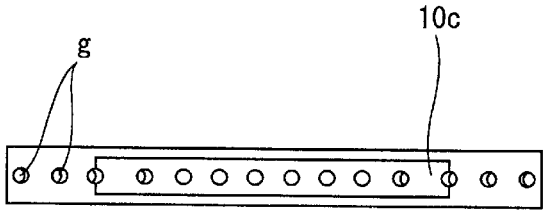
FIG. 4A is a plan view showing the yoke.
Figure 4B:
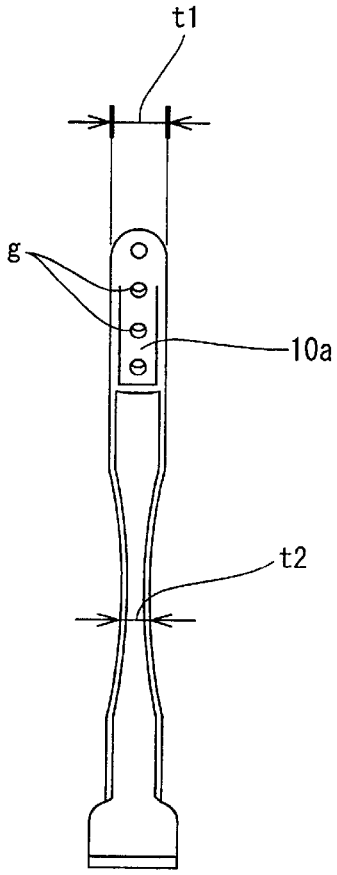
FIG. 4B is a side view showing the yoke.
Figure 4C:
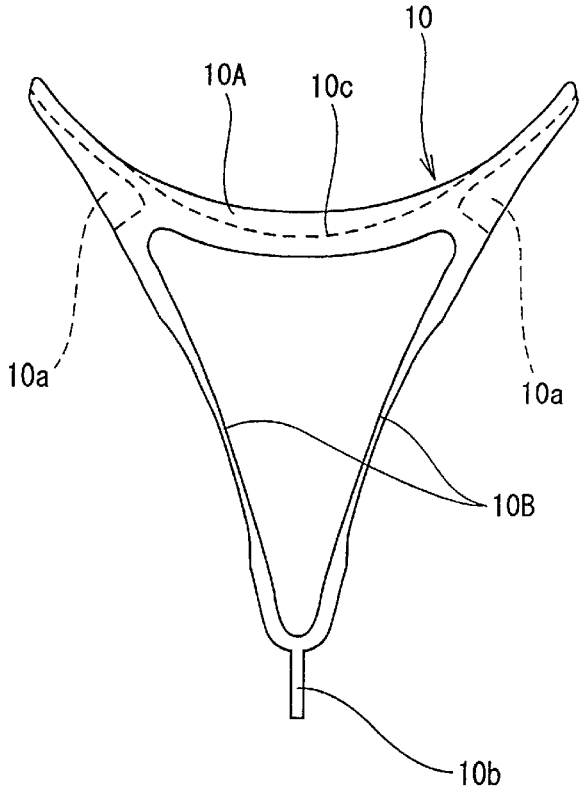
FIG. 4C is a front view showing the yoke.
Figure 4D:
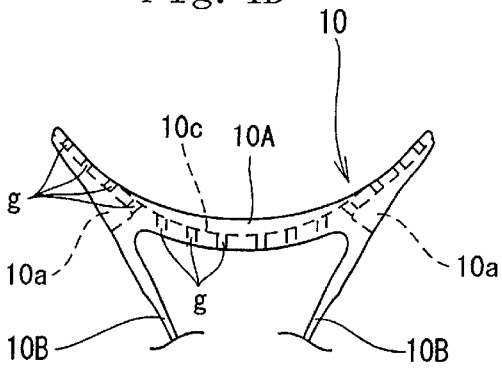
FIG. 4D is a main portion-enlarged view showing the yoke.
Figure 5:
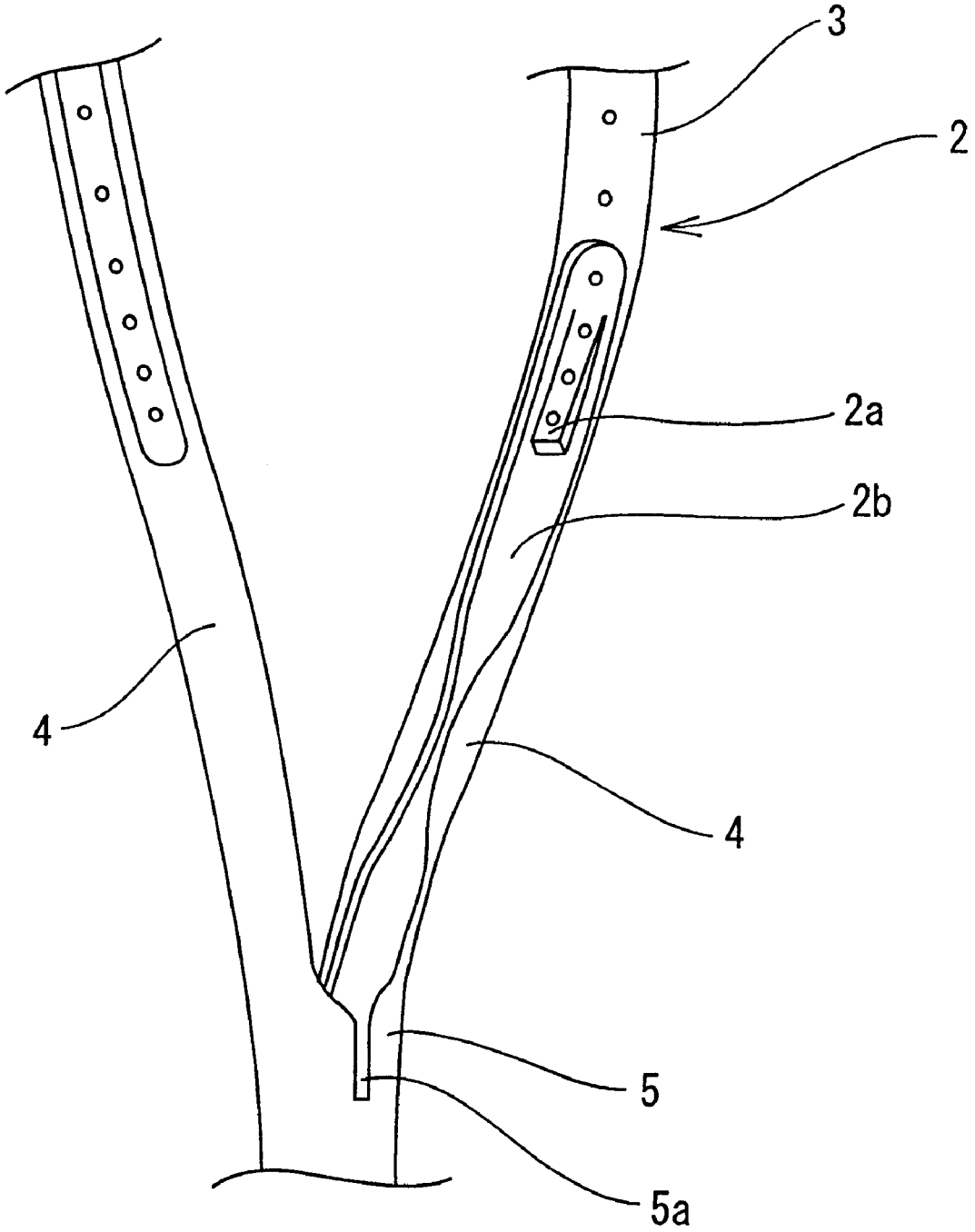
FIG. 5 is a perspective view showing the racket-frame body.

With reference to FIG. 2, at the central position P1 of the yoke 10 in its longitudinal direction, the width X1 of the yoke 10 and its thickness Y1 are 12 mm (0.46 in) and 17 mm (0.66 in) respectively. At the three o'clock position of the head 3, the width X2 of the head 3 and its thickness Y2 are 14 mm ((0.55 in) and 24 mm (0.94 in) respectively.

The yoke body 10A has a concavity 10*a* formed thereon. The yoke 10 and the racket-frame body 2 are mechanically connected to each other by fitting a convexity 2*a* of the racket-frame body 2 and the concavity 10*a* on each other. The racket-frame body 2 and the yoke 10 are connected to each other in an area of 35 $cm^2$ (5.4 $in^2$) at one side thereof and thus 70 $cm^2$ (10.8 $in^2$) at both sides thereof. The yoke 10 and the racket-frame body 2 are connected to each other with a urethane adhesive agent in addition to the mechanical connection. A shear force generated when the racket frame 1 deforms is collectively applied to the connected surface of the racket-frame body 2 and that of the yoke 10 to increase the vibration-damping performance of the racket frame 1.

The connection auxiliary part 10B is extended to the position of five o'clock (seven o'clock) in the head 3, supposing that the head 3 is a clock face. The connection auxiliary part 10B is also extended to the shaft part 5 along the inner surface of the throat part 4. The leading end of the right connection auxiliary part 10B is continuous with that of the left connection auxiliary part 10B to form a hollow triangular space with the connection auxiliary part 10B and the yoke body 10A. A depression 2*b* corresponding to the configuration of the connection auxiliary part 10B is formed on the racket-frame body 2 to lock the connection auxiliary part 10B to the depression 2*b* by fitting both on each other.

The yoke 10 has a projection 10*b* projected from the portion at which the leading end of the right connection auxiliary part 10B is continuous with that of the left connection auxiliary part 10B toward the shaft part 5. The projection 10*b* is inserted into a slit 5*a* formed at the center of a leading end of the shaft part 5. The depth of the slit 5*a* is a little longer than the length of the projection 10*b* to allow the projection 10*b* to be inserted thereinto easily.

With reference to FIG. 4, each of the right and left connection auxiliary part 10B has a uniform thickness t1 in the thickness direction of the racket frame 1 in the vicinity of the yoke body 10A and in the vicinity of the portion of the connection between the connection auxiliary part 10B and the shaft part 5. On the other hand, each of the right and left connection auxiliary part 10B has a gradually decreased thickness toward a point, having a thickness t2, located at the region thereof corresponding to the center region of the throat part 4.

Figure 6:
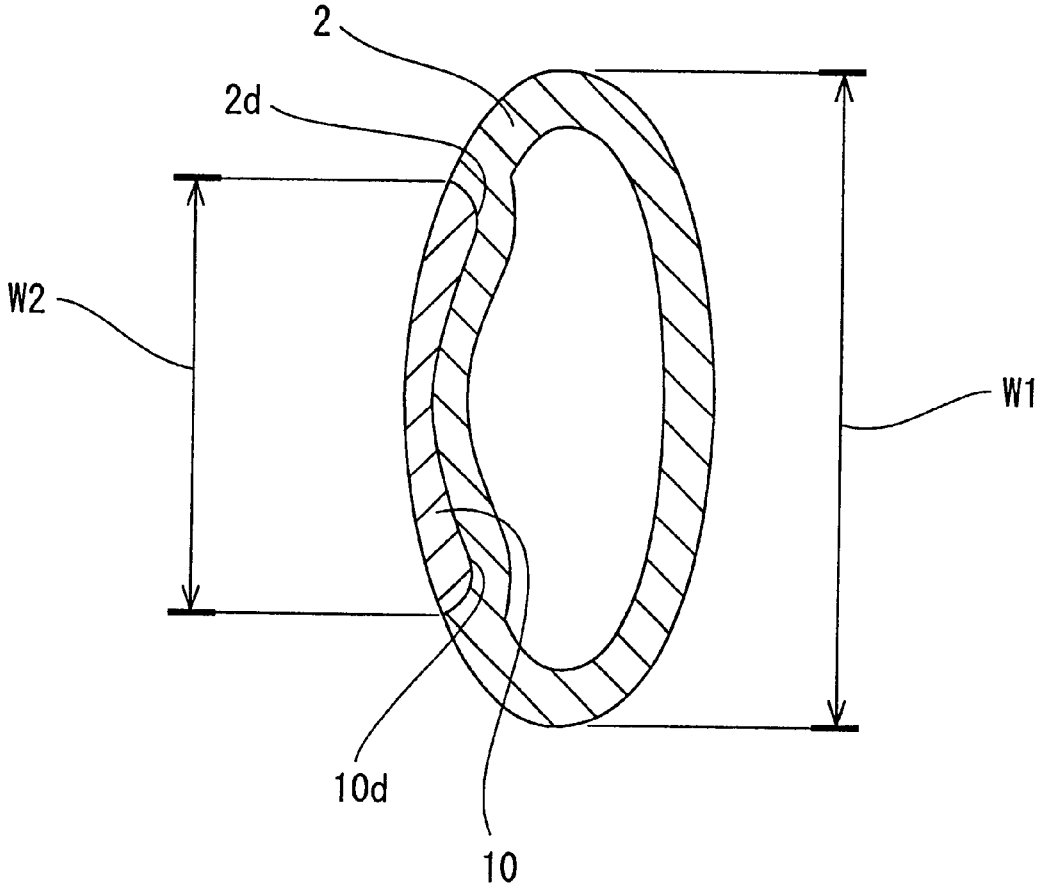
FIG. 6 is a sectional view showing a throat part.

As shown in FIG. 6, the yoke 10 (both ends of the yoke body 10A and the connection auxiliary part 10B extending from both ends of the yoke body 10A) is connected to the racket-frame body 2 at its inner-surface side by connecting an outer surface 10*d* of the yoke 10 (both ends of the yoke body 10A and the connection auxiliary part 10B extending from both ends of the yoke body 10A) and an inner surface 2*d* of th racket-frame body 2 to each other. A dimension W2 of the connection auxiliary part 10B in its thickness direction is set smaller than a dimension W1 of the racket-frame body 2 in its thickness direction to prevent the yoke 10 from projecting from the racket-frame body 2.

In the racket frame 1 of the first embodiment, there is the above-described relationship between the yoke rigidity value and the face rigidity value. Thus when a ball collides with the ball-hitting face F, the head 3 does not deform easily owing to its high rigidity, whereas the yoke 10 flexes easily owing to its low rigidity. Thereby vertical strings can be deformed greatly. Thus it is possible to improve the restitution performance of the racket frame 1. The groove 10*c* is formed inside the yoke 10 to reduce the yoke rigidity value in the ball-hitting face direction. Thereby the movable range of the vertical string is increased to improve the restitution performance of the racket frame 1.

As described above, after the racket-frame body 2 and the yoke 10 are formed as separate members by molding materials, both are connected to each other by the mechanical connection means and the adhesive agent in such a way that a shear force generated when the racket frame 1 deforms is collectively applied to the connection surface of the racket-frame body 2 and that of the yoke 10. Thereby it is possible to increase the vibration-damping performance of the racket frame 1. By appropriately setting the configuration of the yoke body 10A, the connection auxiliary part 10B, and the racket frame 1, the racket frame is allowed to have high vibration-damping performance and further a favorable balance among its weight, rigidity, and strength. Accordingly the racket frame 1 can be used preferably for regulation-ball tennis.

Figure 7:
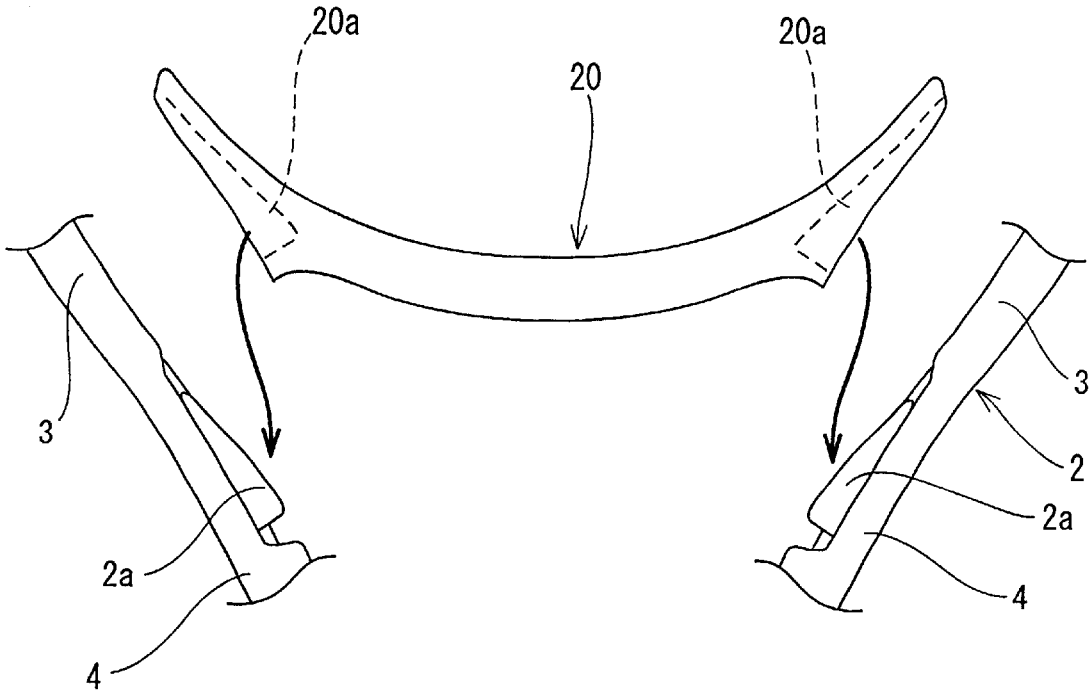
FIG. 7 shows a yoke-mounting situation according to a second embodiment.

FIG. 7 shows a second embodiment. A yoke (approximately columnar rod) 20 consisting of a part connecting the right and left throat parts 4 to each other is formed separately from the racket-frame body 2 by molding a material. The racket-frame body 2 and the yoke 20 are connected to each other with a mechanical means and an adhesive agent. A concavity 20*a* formed on the yoke 20 is mechanically connected to the racket-frame body 2 by fitting a convexity 2*a* of the racket-frame body 2 and the concavity 20*a* on each other.

Figure 8A:
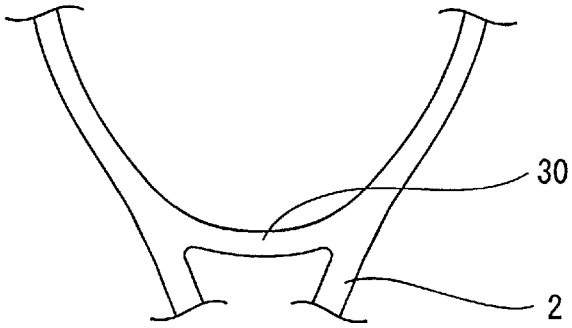
FIG. 8A shows the relationship between a yoke and a racket-frame body.
Figure 8B:
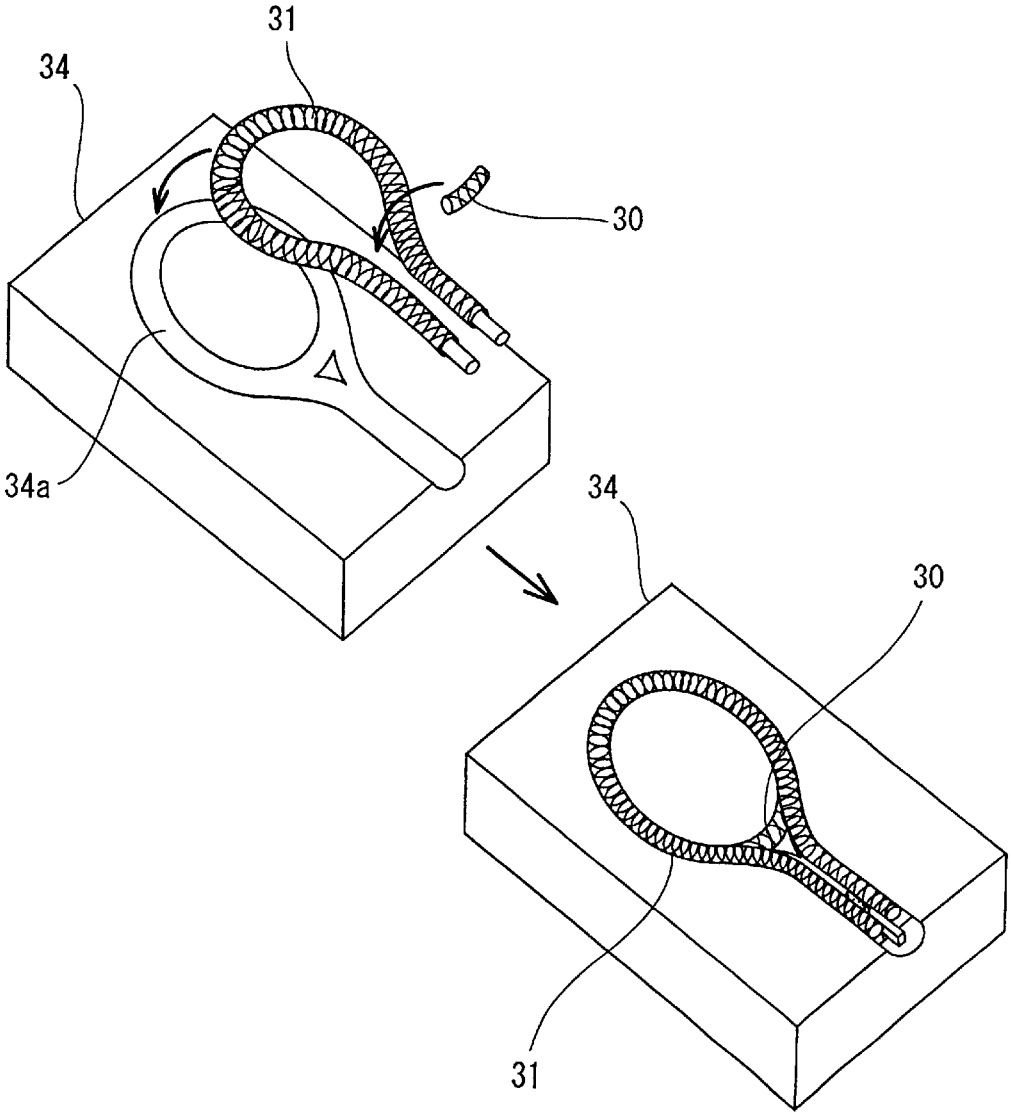
FIG. 8B shows a manufacturing method.

FIGS. 8A and 8B show a third embodiment. A yoke 30 and a racket-frame body 2 are integrally molded. More specifically, a fiber reinforced molded material (layup) 31 composed of a laminate of vertical fiber reinforced prepregs is prepared. The layup 31 is filled into a cavity 34*a* of a molding die 34. The unhardened yoke 30 consisting of a part connecting right and left throat parts to each other is disposed in the cavity 34*a* at its predetermined position. The die is clamped to obtain the yoke (approximately columnar rod-shaped) and the racket-frame body by integral molding.

In the third embodiment, the yoke is formed by molding a fiber-reinforced thermoplastic resin superior in moldability and vibration-damping performance. In addition, the yoke can be formed by molding other materials satisfying the above-described rigidity values to allow the yoke to have a strength and be lightweight depending upon the performance demanded. A vibration-damping film may be sandwiched between the connection surface of the yoke and that of the racket-frame body. Thereby the vibration-damping performance can be improved further.

EXAMPLES

The racket frame of each of examples 1–5 of the present invention and comparison examples 1 through 3 will be described below in detail.

The racket-frame body of each of the examples and comparison examples was hollow and made of a fiber reinforced resin consisting of epoxy resin serving as the matrix resin. The sectional configuration of each racket-frame body was that the thickness was 24 mm (0.93 in) and the width was 13 mm (0.51 in)–15 mm (0.59 in). The ball-hitting area of each of racket-frame bodies was equally 110 square inches (707 $cm^2$). They were prepared by the following method.

Prepreg sheets (carbon fiber prepreg (Toray T300, 700, 800, M46J)) made of fiber reinforced thermosetting resin reinforced with carbon fiber serving ware layered at angles of 0°, 22°, 30°, and 90° on a mandrel (φ14.5) coated with an internal-pressure tube made of 66 nylon, and a vertical prepreg laminate was molded. After the mandrel was removed from the laminate, the laminate was set in a die. In this state, the die was clamped and heated at 1500 for 30 minutes, with an air pressure of 9 $kgf/cm^2$ (128 psi) kept in the internal-pressure tube to prepare each specimen.

The material, characteristic, and weight of the yoke, the raw frame (weight/balance), the racket frame (weight/balance), the yoke rigidity value, and face rigidity value were set as shown in tables 1 and 2.

TABLE 1

| | E1 | E2 | E3 | E4 | E5 |
|---|---|---|---|---|---|
| Material for yoke | 66 nylon 15% of CF short fiber | 66 nylon 15% of CF short fiber | 66 nylon 22% of CF short fiber | 66 nylon 15% of CF short fiber | 66 nylon 15% of CF short fiber |
| Characteristic of yoke | •Groove in yoke •Mechanical connection •Yoke body + connection auxiliary part | •Mechanical connection •Yoke body + connection auxiliary part | •Groove in yoke •Mechanical connection •Yoke body + connection auxiliary part | •Groove in yoke •Mechanical connection •Yoke (right and left throat parts connection part) | •Integral molding •Yoke (right and left throat parts connection part) |
| Weight of yoke (g) (lbs) | 33 (0.072) | 36 (0.079) | 35 (0.077) | 25 (0.055) | 25 (0.055) |
| Raw frame Weight/balance (g/mm) (lbs/in) | 193/358 0.424/13.9 | 196/357 0.431/13.9 | 195/357 0.429/13.9 | 185/360 0.407/14.0 | 190/357 0.418/13.9 |
| Racket frame Weight/balance (g/mm) (lbs/in) | 245/355 0.539/13.8 | 247/356 0.543/13.8 | 246/355 0.541/13.8 | 238/358 0.524/14.0 | 242/354 0.532/13.8 |
| Yoke rigidity value A (kgf/cm) (lbf/in) | 258 1455 | 312 1759 | 450 2358 | 258 1455 | 258 1455 |
| Face rigidity value B (kgf/cm) (lbf/in) | 670 3778 | 670 3778 | 670 3778 | 670 3778 | 670 3778 |
| Rate of A/B | 39% | 46% | 67% | 39% | 39% |
| Out-of-plane primary frequency (Hz) | 163 | 164 | 164 | 165 | 164 |
| Out-of-plane primary damping factor (%) | 0.9 | 0.8 | 0.6 | 0.8 | 0.7 |
| Out-of-plane secondary frequency (Hz) | 455 | 458 | 467 | 457 | 455 |
| Out-of-plane secondary damping factor (%) | 1.0 | 0.9 | 0.9 | 0.9 | 0.8 |
| Restitution coefficient | 0.424 | 0.410 | 0.413 | 0.422 | 0.411 |
| Durability | 3 | 3 | 3 | 3 | 2 |

TABLE 2

| | CE1 | CE2 | CE3 |
|---|---|---|---|
| Material for yoke | 66 nylon 45% of CF short fiber | PEBAX (trade name) | Same as material of racket-frame body |
| Characteristic of yoke | •Groove in yoke •Mechanical connection | •Groove in yoke •Mechanical connection | •Integral molding •Yoke (right and left throat parts connection |

TABLE 2-continued

| | CE1 | CE2 | CE3 |
|---|---|---|---|
| | •Yoke body + connection auxiliary part | •Yoke body + connection auxiliary part | part) |
| Weight of yoke (g) (lbs) | 38 (0.83) | 36 (0.079) | — |
| Raw frame | 198/357 | 196/358 | 187/363 |
| Weight/balance (g/mm) (lbs/in) | 0.435/13.9 | 0.431/13.9 | 0.411/14.1 |
| Racket frame | 250/354 | 247/355 | 236/360 |
| Weight/balance (g/mm) (lbs/in) | 0.550/13.9 | 0.543/13.8 | 0.519/14.0 |
| Yoke rigidity value A (kgf/cm) | 510 | 59 | 800 |
| (lbf/in) | 2876 | 333 | 4512 |
| Face rigidity value B (kgf/cm) | 670 | 670 | 670 |
| (lbf/in) | 3779 | 3779 | 3779 |
| Rate of A/B | 76% | 9% | 119% |
| Out-of-plane primary frequency (Hz) | 169 | 165 | 164 |
| Out-of-plane primary damping factor (%) | 0.7 | 0.7 | 0.3 |
| Out-of-plane secondary frequency (Hz) | 471 | 459 | 464 |
| Out-of-plane secondary damping factor (%) | 0.9 | 0.8 | 0.3 |
| Restitution coefficient | 0.401 | 0.428 | 0.402 |
| Durability | 1 | 1 | 3 |

where E denotes embodiment and CE denotes comparison example.

Example 1

Separately from the racket-frame body, using a material composed of 66 nylon filled with 15% of carbon fibers (short fiber) having a length of 1 mm (0.039 in) and an injection-molding die, the solid yoke was formed. A concavity was formed on the yoke. A convexity formed on each racket-frame body was fitted on the concavity formed on the yoke to connect the yoke and the racket-frame body to each other with a mechanical means and urethane adhesive agent.

A groove (concavity on yoke) having a width of 5 mm (0.20 in) and a depth of 5 mm (0.20 in) was disposed on the yoke at its ball-hitting face side.

The yoke is connected to the racket-frame body in the range of the right and left throat parts to the head to forman approximately hollow triangular space (yoke and shaft part are integral) in the range of the yoke to the shaft part. That is, the yoke had the same configuration as that of the first embodiment.

Example 2

The specification of the racket frame of the example 2 was similar to that of the example 1 except that the concavity (groove) was not formed on the yoke.

Example 3

The specification of the racket frame of the example 3 was similar to that of the example 1 except that the yoke was made of 66 nylon and 22% of short carbon fibers reinforcing the 66 nylon.

Example 4

The yoke (approximately columnar rod-shaped) consisting of a portion connecting right and left throat parts to each other was connected to the racket-frame body with a mechanical means and an adhesive agent. Except that the configuration of the yoke was the same as that of the second embodiment shown in FIG. 7, the specification of the racket frame of the example 4 was similar to that of the example 1. That is, the yoke did not include the connection auxiliary part.

Example 5

An unhardened yoke (approximately columnar rod-shaped) consisting of a portion connecting right and left throat parts to each other was formed by integrally molding the material for the yoke and the material for the racket-frame body. That is, the yoke had the same configuration as that of the third embodiment shown in FIG. 8. The material for the yoke was the same as that for the yoke of the first embodiment.

Comparison Example 1

The specification of the racket frame of the comparison example 1 was similar to that of the example 1 except that the yoke was made of 66 nylon and 45% of short carbon fibers reinforcing the 66 nylon.

Comparison Example 2

The specification of the racket frame of the comparison example 2 was similar to that of the example 1 except that the yoke was made of polyether block amide (PEBAX 5533 produced by Atochem, Inc.)

Comparison Example 3

The racket-frame body was formed by integrally molding the unhardened material for each of the yoke and the racket-frame body by a conventional method, with both unhardened materials set together in a die. Similarly to the racket-frame body, the yoke was made of epoxy resin reinforced with carbon fiber, and foamed material was inserted into the hollow portion of the yoke.

The racket frames of each of the examples 1–5 and comparison examples 1–3 were measured by the method which will be described later for the frequency of the out-of-plane primary vibration, the out-of-plane primary vibration-damping factor, the frequency of the out-of-plane secondary vibration, the out-of-plane secondary vibration-damping factor, and the restitution coefficient. A durability test was also conducted. Tables 1 and 2 show the test results.

Measurement of Yoke Rigidity Value and Face Rigidity Value

Figure 9:
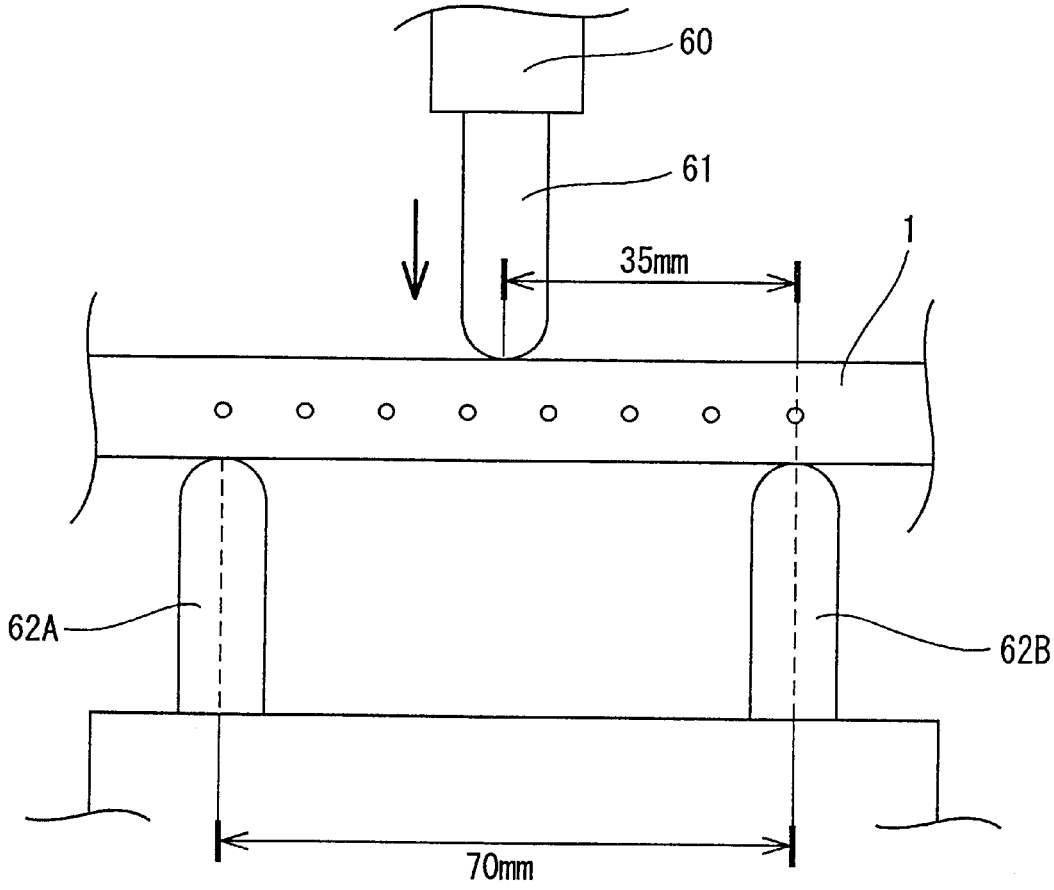
FIG. 9 shows a method of measuring a yoke rigidity value and a face rigidity value.

As shown in FIG. 9, using a universal testing machine 60, the rigidity value was measured by three-point bending. The portion of the racket frame 1 to be measured (predetermined position of yoke or head) was disposed on jigs 62A and 62B in such a way that the point to be measured was located under an indenter 61 of the universal testing machine 60. The interval between the jigs 62A and 62B was set to 70 mm (2.73 in). The indenter 61 was set at the center between the jigs 62A and 62B. The radius of curvature of the leading end of the indenter 61 was set to 5R. The radius of curvature of the leading end of each of the jigs 62A and 62B was set to 10R. The indenter 61 was dropped at a speed of 5 mm/min (0.2 in/min) in a direction vertical to ball-hitting face to compute the spring constant from the displacement at the load-applied time. Thereby the rigidity value was measured. The load-applied points were the center of the yoke in its longitudinal direction and three and 12 o'clock positions in the head. That is, the center of a cut-out portion having a length of 70 mm (2.73 in) was set to the center of the yoke in its longitudinal direction, the three o'clock position, and the 12 o'clock position.

The yoke and the head of the racket frame were measured. More specifically, the load was applied to the center of the yoke in its longitudinal direction, the three o'clock position, and the 12 o'clock position by the indenter. The rigidity value at the center of the yoke in its longitudinal direction was the yoke rigidity value. The average of the rigidity value at the 12 o'clock position and that at the three o'clock position was the face rigidity value.

Measurement of Out-of-plane Primary Damping Factor

Figure 10A:
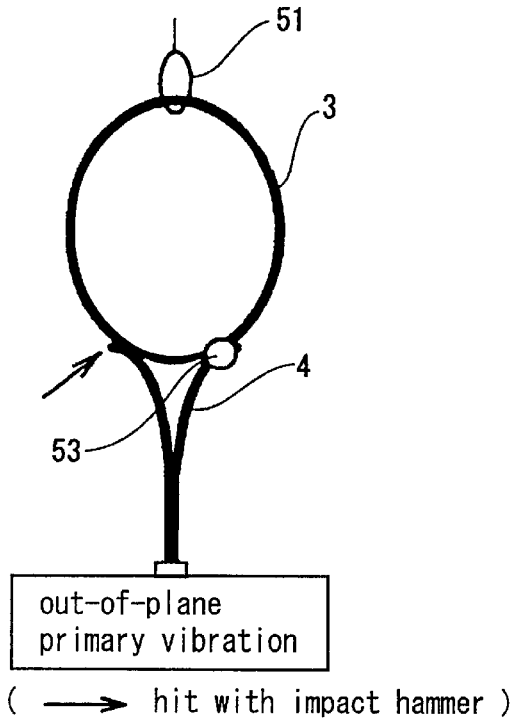
FIGS. 10A, 10B, and 10C are schematic views showing methods of measuring the vibration-damping factor of the racket frame.

As shown in FIG. 10A, with the upper end of the head 3 hung with a string 51, an acceleration pick-up meter 53 was installed on one connection portion between the head 3 and the throat part 4, with the acceleration pick-up meter 53 perpendicular to the face of the racket frame. As shown in FIGS. 10B, in this state, the other connection portion between the head 3 and the throat part 4 was hit with an impact hammer 55 to vibrate the racket frame. An input vibration (F) measured by a force pick-up meter installed on an impact hammer 55 and a response vibration ($\alpha$) measured by the acceleration pick-up meter 53 were input to a frequency analyzer 57 (dynamic single analyzer HP3562A manufactured by Fuhret Packard Inc.) through amplifiers 56A and 56B. A transmission function in the frequency region obtained by an analysis was calculated to obtain the frequency of the racket frame. The vibration-damping ratio ($\zeta$) of the racket frame, namely, the out-of-plane primary vibration-damping factor thereof was computed by an equation shown below. Tables 1 and 2show the average of values obtained by measurement and computation performed for a plurality of the racket frames of each of the examples and the comparison examples.

$$\zeta=(1/2)\times(\Delta\omega/\omega n)$$

$$To=Tn/\sqrt{2}$$

Measurement of Out-of-plane Secondary Vibration-Damping Factor

Figure 10C:
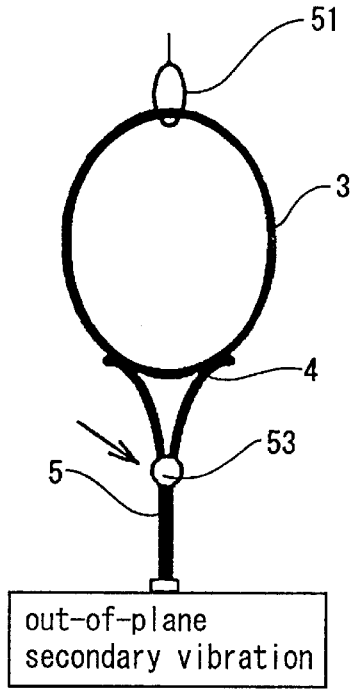
Figure 10B:
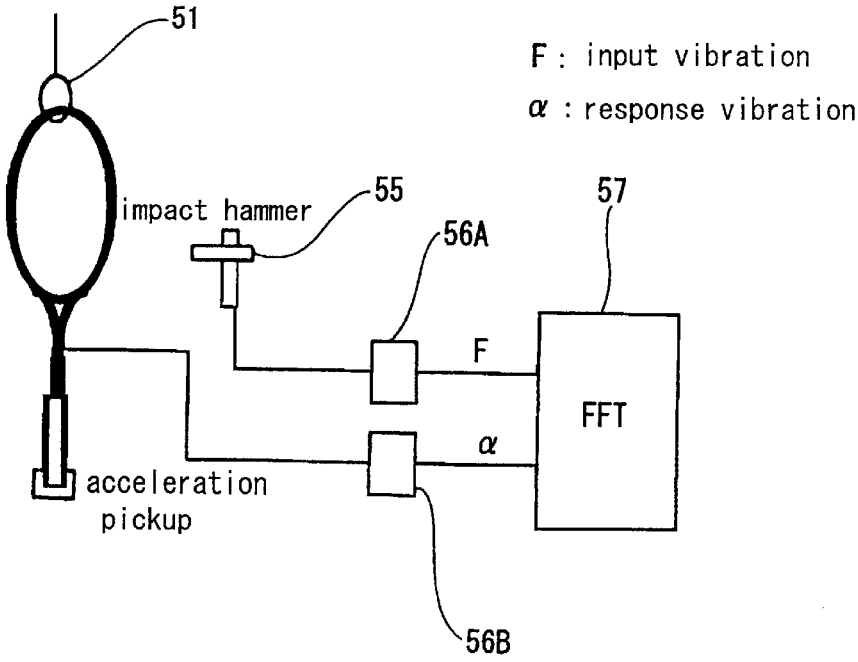

As shown in FIG. 10C, with the upper end of the head 3 of the racket frame hung with the string 51, the acceleration pick-up meter 53 was installed on one connection portion between the throat part 4 and the shaft part 5, with the acceleration pick-up meter 53 perpendicular to the face of the racket frame. In this state, the rear side of the racket frame at a portion thereof confronting the pick-up meter-installed position was hit with the impact hammer 55 to vibrate the racket frame. The damping factor, namely, the out-of-plane secondary vibration-damping factor of the racket frame was computed by a method equivalent to the method of computing the out-of-plane primary vibration-damping factor. Tables 1 and 2 show the average of values obtained by measurement and computation performed for a plurality of the racket frames of each of the examples and the comparison examples.

Method of Testing Durability

The grip part of each racket frame was fixed with an intermediary of a rubber hose. A ball collided with the ball-hitting face of the racket frame at a speed of 75 m/sec (248 ft/sec) at a position 10 cm (25.4 in) apart from the top of the head to count the number of breakage times at small number of collision times by making the ball speed much higher than the normal speed in a tennis-playing time. Strings were stretched on each racket frame at a tensile force of 65 lb (30 kg) for warp and 60 lb (27 kg) for weft. The durability was evaluated in three stages: The racket frame broken at less than 1000 collision times was denoted by "1". The racket frame broken at 1000–1600 collision times was denoted by "2". The racket frame not broken at 1600 collision times was denoted by "3".

Measurement of Restitution Coefficient

Figure 11:
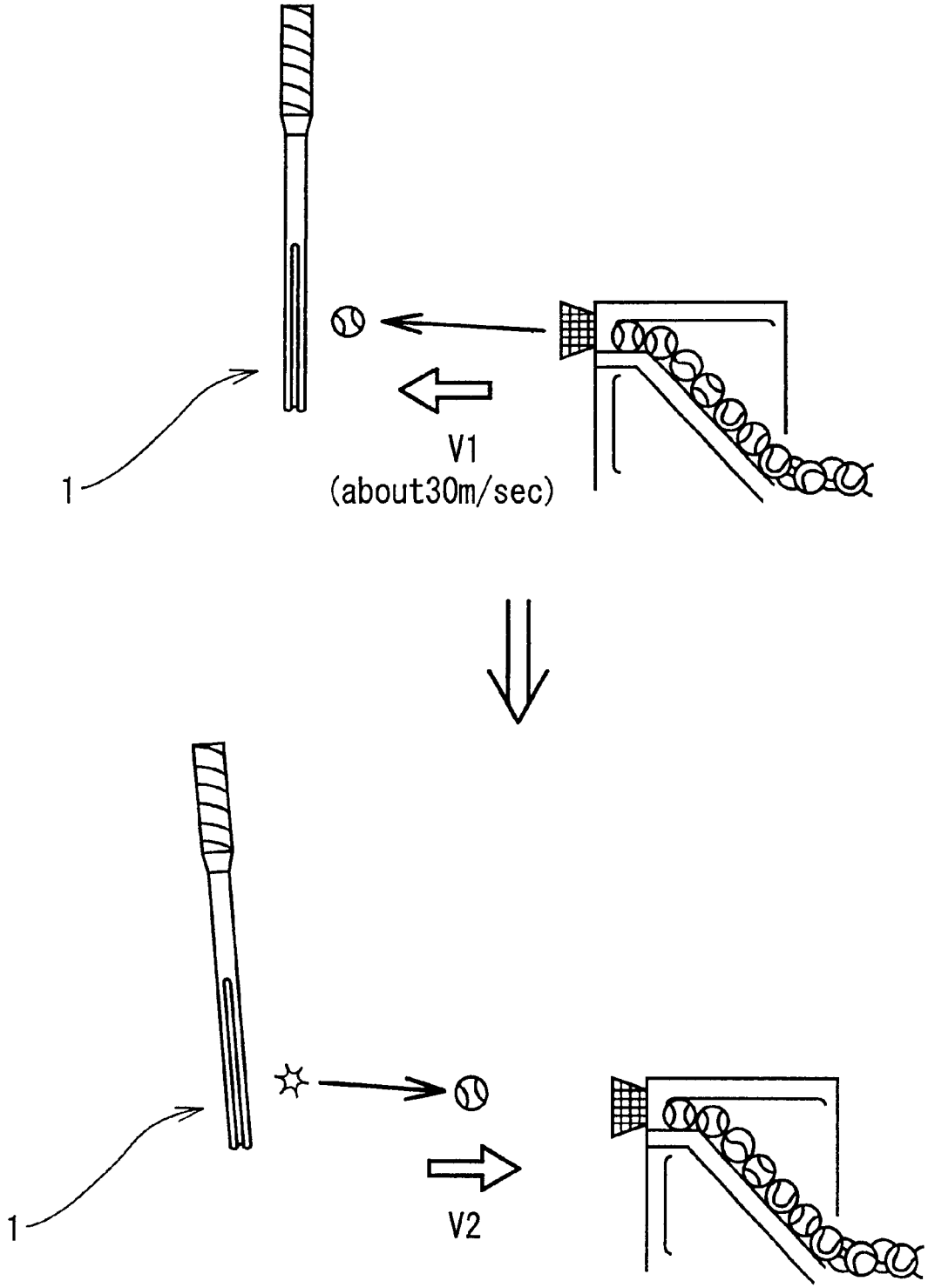
FIG. 11 shows a method of measuring a restitution coefficient.

As shown in FIG. 11, the racket frame 1 of each of the examples and comparison examples was hung gently and vertically in such a way that the grip part was free. A tennis ball was launched from a ball launcher at a constant speed of V1 (30 m/sec (99 ft/sec)) to allow the tennis ball to collide with the ball-hitting face of the racket frame. The rebound speed V2 of the tennis ball was measured. The restitution coefficient is the ratio of the rebound speed V2 to the launched speed V1. The larger the restitution coefficient is, the longer the tennis ball flies. The restitution coefficient at the center (face center) of the ball-hitting face was measured.

As shown in tables 1 and 2, the yoke rigidity value of each of the racket frames of the examples 1–5 is in the range of 10% to 70% of the face rigidity value. Therefore they are lightweight, namely, in the range of 238 g (0.523 lbs) to 247 g (0.543 lbs) and the restitution performances thereof are high, namely, in the range of 0.410 to 0.424. The evaluation marks of the durability thereof are two and three, which is favorable. That is, they have high restitution performance without deteriorating its strength. The out-of-plane primary vibration damping factors thereof are in the range of 0.6–0.9, and the out-of-plane secondary vibration damping factors thereof are in the range of 0.8 to 1.0. That is, they have very high vibration-damping performance.

On the other hand, as to the racket frame of the comparison example 1, since the yoke rigidity value is 76% of the face rigidity value, its restitution coefficient is low, namely, 0.401 and its durability is low. As to the racket frame of the comparison example 2, its restitution coefficient is 0.428, which is excellent. However it has a very low yoke rigidity value. Thus it has a low durability and further a very low strength. As to the racket frame of the comparison example 3, since the yoke rigidity value is very high, it has a superior durability. However its restitution coefficient is low, namely, 0.402.

As apparent from the foregoing description, according to the present invention, the yoke rigidity value vertical to the ball-hitting face is set smaller than the face rigidity value which is the average of the rigidity value at the 12 o'clock position of the head vertical to the ball-hitting face and the rigidity value at the three o'clock position thereof of the head vertical to the ball-hitting face. The head does not deform easily owing to its high rigidity, whereas the yoke flexes easily with the ball-hitting face owing to its low rigidity when a ball collides with the string-stretched ball-hitting face. Thereby vertical strings (guts) can be deformed greatly. Thus it is possible for the racket frame whose body is made of a fiber reinforced resin to have improved restitution performance without deteriorating its strength.

A groove is formed on the yoke at the ball-hitting face side thereof along the circumferential direction of the ball-hitting face. Thereby it is possible to efficiently reduce the yoke rigidity value vertical to the ball-hitting face and increase the movable range of the vertical string. Therefore it is possible to improve the restitution performance of the racket frame.

Further, after the racket-frame body and the yoke are separately formed by molding the material for each of the racket-frame body and the yoke, the yoke and the racket-frame body are connected to each other by a mechanical connection means and/or an adhesive agent. A shear force generated when the racket frame deforms is collectively applied to the connection surface of the racket-frame body and the yoke to increase the vibration-damping performance of the racket frame.

What is claimed is:

1. A racket frame having a pipe-shaped racket-frame body made of a fiber reinforced resin and composed of a head part, a throat part, a shaft part, and a grip part sequentially arranged and a yoke connected to said racket-frame body, wherein supposing that said head part is a clock face and that a top position of said head part is 12 o'clock, a yoke rigidity value at a central position, which is a vertical direction to a ball-hitting face, of said yoke in a longitudinal direction, is in a range of 10% to 70% of a face rigidity value which is an average of a rigidity value of a vertical direction to said ball-hitting face at a 12 o'clock position of said head part and at a three o'clock position of said head part.

2. The racket frame according to claim 1, wherein said yoke rigidity value is not less than 60 kgf/cm (338 lbf/in) nor more than 500 kgf/cm (2820 lbf/in).

3. The racket frame according to claim 1, wherein said yoke consists of a fiber reinforced resin, a resin or a metal or a composite material thereof.

4. The racket frame according to claim 1, wherein a groove is formed on said yoke at a ball-hitting face side thereof along a circumferential direction of said ball-hitting face.

5. The racket frame according to claim 1, wherein said racket-frame body and said yoke are formed separately; and said yoke and said racket-frame body are connected to each other by a mechanical connection means or/and an adhesive agent, by joining both ends of said yoke to said right and left parts of said racket-frame body respectively in an area of not less than 10 $cm^2$ (1.6 $in^2$).

6. The racket frame according to claim 1, wherein an adhesive agent superior in vibration-absorbing property or/and a vibration-damping film or a vibration-damping sheet are interposed on a boundary surface between said racket-frame body and said yoke.

7. The racket frame according to claim 1, wherein said yoke has right and left connection auxiliary parts each extending from one end of a yoke body that closes an opening of said head part, with each of said right and left connection auxiliary parts extending across a boundary between said head part and said throat part; each of said right and left connection auxiliary parts is extended up to a position of four o'clock (eight o'clock) of said head part, supposing that said head part is a clock face; and each of said right and left connection auxiliary parts is extended up to said shaft part; and each of said right and left connection auxiliary parts has an equal and uniform dimension in one region and a nonuniform dimension in other region in a thickness direction thereof.

8. The racket frame according to claim 7, wherein each of said right and left connection auxiliary parts of said yoke is extended to said shaft part along an inner surface of said throat part in such a way that a leading end of said right connection auxiliary part is continuous with that of said left connection auxiliary part to form an approximately hollow triangular space with said connection auxiliary part and said body of said yoke.

9. The racket frame according to claim 8, wherein said yoke has a projection projected from a portion at which said leading end of said right connection auxiliary part is continuous with said leading end of said left connection auxiliary part toward said shaft part; and said projection is inserted into a slit formed at a center of a leading end of said shaft part.

10. The racket frame according to claim 7, wherein both ends of said body of said yoke and a connection auxiliary part extending from said both ends of said body of said yoke are connected to an inner-surface side of said racket-frame body by superimposing an outer surface of said connection auxiliary part and an inner surface of said racket-frame body on each other or by fitting said connection auxiliary part on a fit-on portion formed on said inner surface of said racket-frame body in correspondence to a configuration of said connection auxiliary part.

11. The racket frame according to claim 1, wherein a weight of said yoke is set to a range of 5%–30% of a weight of a raw frame whose weight is an addition of a weight of said yoke and that of said racket-frame body.

* * * * *